US009874067B2

(12) United States Patent
Themig et al.

(10) Patent No.: US 9,874,067 B2
(45) Date of Patent: Jan. 23, 2018

(54) SLIDING SLEEVE SUB AND METHOD AND APPARATUS FOR WELLBORE FLUID TREATMENT

(71) Applicant: PACKERS PLUS ENERGY SERVICES INC., Calgary (CA)

(72) Inventors: Daniel Jon Themig, Calgary (CA); Christopher Denis Desranleau, Sherwood Park (CA); Kevin O. Trahan, The Woodlands, TX (US); Frank Delucia, Houston, TX (US); Daniel P. Lupien, Edmonton (CA); Terrance Dean Maxwell, Edmonton (CA)

( * ) Notice: Subject to any disclaimer, the term of this patent is extended or adjusted under 35 U.S.C. 154(b) by 67 days.

(21) Appl. No.: 14/672,766

(22) Filed: Mar. 30, 2015

(65) Prior Publication Data

US 2015/0204164 A1 Jul. 23, 2015

Related U.S. Application Data

(63) Continuation of application No. 13/146,087, filed as application No. PCT/CA2010/000727 on May 7, 2010, now Pat. No. 9,010,447.

(60) Provisional application No. 61/176,334, filed on May 7, 2009, provisional application No. 61/326,776, filed on Apr. 22, 2010.

(51) Int. Cl.

| | |
|---|---|
| ***E21B 34/14*** | (2006.01) |
| ***E21B 33/12*** | (2006.01) |
| ***E21B 33/124*** | (2006.01) |
| ***E21B 34/12*** | (2006.01) |
| ***E21B 43/26*** | (2006.01) |
| *E21B 34/00* | (2006.01) |

(52) U.S. Cl.

CPC ..... *E21B 33/12* (2013.01); *E21B 33/124* (2013.01); *E21B 34/12* (2013.01); *E21B 34/14* (2013.01); *E21B 43/26* (2013.01); *E21B 2034/007* (2013.01)

(58) Field of Classification Search

CPC ... E21B 34/14; E21B 2034/007; E21B 23/004
See application file for complete search history.

(56) References Cited

U.S. PATENT DOCUMENTS

| | | | |
|---|---|---|---|
| 2,155,609 | A | 4/1939 | McClendon et al. |
| 2,947,363 | A | 8/1960 | Sackett et al. |
| 3,053,322 | A | 9/1962 | Kline |
| 3,054,415 | A | 9/1962 | Baker et al. |
| 3,112,796 | A | 12/1963 | Myers |
| 4,176,717 | A | 12/1979 | Hix |
| 4,520,870 | A | 6/1985 | Pringle |
| 4,593,678 | A | 6/1986 | Piper |
| 4,893,678 | A | 1/1990 | Stokley et al. |
| 6,053,250 | A | 4/2000 | Echols |
| 6,634,428 | B2 | 10/2003 | Krauss et al. |

(Continued)

FOREIGN PATENT DOCUMENTS

| | | | |
|---|---|---|---|
| CA | 2668129 | A1 | 12/2009 |
| WO | WO 20047/022906 | A1 | 3/2004 |

*Primary Examiner* — Cathleen R Hutchins

(57) ABSTRACT

A tubing string assembly is disclosed for fluid treatment of a wellbore. The tubing string can be used for staged wellbore fluid treatment where a selected segment of the wellbore is treated, while other segments are sealed off. The tubing string can also be used where a ported tubing string is required to be run in in a pressure tight condition and later is needed to be in an open-port condition.

13 Claims, 14 Drawing Sheets

(56) References Cited

U.S. PATENT DOCUMENTS

| | | | |
|---|---|---|---|
| 6,907,936 | B2 | 6/2005 | Fehr et al. |
| 7,021,389 | B2 | 4/2006 | Bishop et al. |
| 7,108,067 | B2 | 9/2006 | Themig et al. |
| 7,861,774 | B2 | 1/2011 | Fehr et al. |
| 8,261,761 | B2 | 9/2012 | Gerrard et al. |
| 2006/0243455 | A1 | 11/2006 | Telfer et al. |
| 2006/0260818 | A1 | 11/2006 | Meijer et al. |
| 2007/0272413 | A1 | 11/2007 | Rytlewski et al. |
| 2008/0000697 | A1 | 1/2008 | Rytkewski |
| 2011/0100643 | A1 | 5/2011 | Themig et al. |
| 2011/0108284 | A1 | 5/2011 | Flores et al. |
| 2011/0127047 | A1 | 6/2011 | Themig et al. |

SLIDING SLEEVE SUB AND METHOD AND APPARATUS FOR WELLBORE FLUID TREATMENT

CROSS REFERENCE TO RELATED APPLICATIONS

This application is a continuation of U.S. application Ser. No. 13/146,087 filed May 7, 2010 which is presently and which is a 371 of PCT/CA2010/00727 filed May 7, 2010 and claims priority to U.S. provisional application Ser. No. 61/176,334, filed May 7, 2009 and to U.S. provisional application Ser. No. 61/326,776 filed Apr. 22, 2010.

FIELD OF THE INVENTION

The invention relates to a method and apparatus for wellbore fluid treatment and, in particular, to a method and apparatus for selective communication to a wellbore for fluid treatment.

BACKGROUND OF THE INVENTION

Recently, as described in U.S. Pat. Nos. 6,907,936 and 7,108,067 to Packers Plus Energy Services Inc., the assignee of the present application, wellbore treatment apparatus have been developed that include a wellbore treatment string for staged well treatment. The wellbore treatment string is useful to create a plurality of isolated zones within a well and includes an openable port system that allows selected access to each such isolated zone. The treatment string includes a tubular string carrying a plurality of packers that can be set in the hole to create isolated zones therebetween about the annulus of the tubing string. Between at least various of the packers, openable ports through the tubing string are positioned. The ports are selectively openable and include a sleeve thereover with a sealable seat formed in the inner diameter of the sleeve. By launching a ball, the ball can seal against the seat and pressure can be increased behind the ball to drive the sleeve through the tubing string, such driving acting to open the port in one zone. The seat in each sleeve can be formed to accept a ball of a selected diameter but to allow balls of lower diameters to pass.

Unfortunately, limitations with respect to the inner diameter of wellbore tubulars, due to the inner diameter of the well itself, such wellbore treatment system may tend to be limited in the number of zones that may be accessed. For example, if the well diameter dictates that the largest sleeve in a well can at most accept a 3¾" ball, then the well treatment string will generally be limited to approximately 11 sleeves and therefore can treat in only 11 stages.

SUMMARY OF THE INVENTION

In one embodiment, there is provided a sliding sleeve sub for installation in a wellbore tubular string, the sliding sleeve sub comprising: a tubular including an inner bore defined by an inner wall; and a sleeve installed in the tubular inner bore and axially slidable therein at least from a first position to a second position, the sleeve including an inner diameter, an outer diameter facing the tubular inner wall, a driver for the sleeve selected to be acted upon by an inner bore conveyed actuating device passing adjacent thereto to drive the generation on the sleeve of a ball stop, the ball stop being formed to retain and hold an inner bore conveyed ball passing along the inner bore and position the inner bore conveyed ball to form a seal against fluid flow therepast.

In one embodiment, there is provided a sliding sleeve sub for installation in a wellbore tubular string, the sliding sleeve sub comprising: a tubular including an inner bore defined by an inner wall; and a sleeve installed in the tubular inner bore and axially slidable therein at least from a first position to a second position, the sleeve including an inner diameter, an outer diameter facing the tubular inner wall, a driver for the sleeve selected to be acted upon by an inner bore conveyed actuating device passing adjacent thereto to drive the generation of a ball stop on the sleeve, the driver being selected to be acted upon to remain in a passive condition until being actuated to move into an active, ball stop-generating position.

In one embodiment, there is provided a wellbore tubing string apparatus, the apparatus comprising: a tubing string having a long axis and an inner bore; a first sleeve in the tubing string inner bore, the first sleeve being moveable along the inner bore from a first position to a second position; and an actuating device moveable through the inner bore for actuating the first sleeve, as it passes thereby, to form a ball stop on the first sleeve.

In one embodiment, there is provided a wellbore tubing string apparatus, the apparatus comprising: a tubing string having a long axis and an inner bore; a first sleeve in the tubing string inner bore, the first sleeve being moveable along the inner bore from a first position to a second position; a second sleeve, the second sleeve offset from the first sleeve along the long axis of the tubing string, the second sleeve being moveable along the inner bore from a third position to a fourth position; and a sleeve shifting ball for both (i) actuating the first sleeve, as it passes thereby, to form a ball stop on the first sleeve and (ii) for landing in and creating a seal against the second sleeve to permit the second sleeve to be driven by fluid pressure from the third position to the fourth position.

In one embodiment, there is provided a wellbore fluid treatment apparatus, the apparatus comprising a tubing string having a long axis, a first port opened through the wall of the tubing string, a second port opened through the wall of the tubing string, the second port offset from the first port along the long axis of the tubing string, a first packer operable to seal about the tubing string and mounted on the tubing string to act in a position offset from the first port along the long axis of the tubing string, a second packer operable to seal about the tubing string and mounted on the tubing string to act in a position between the first port and the second port along the long axis of the tubing string; a third packer operable to seal about the tubing string and mounted on the tubing string to act in a position offset from the second port along the long axis of the tubing string and on a side of the second port opposite the second packer; a first sleeve positioned relative to the first port, the first sleeve being moveable relative to the first port between a closed port position and a position permitting fluid flow through the first port from the tubing string inner bore; a second sleeve positioned relative to the second port, the second sleeve being moveable relative to the second port between a closed port position and a position permitting fluid flow through the second port from the tubing string inner bore; and a sleeve shifting device for both (i) actuating the first sleeve, as it passes thereby, to form a ball stop on the first sleeve and (ii) for landing in and creating a seal against the second sleeve to permit the second sleeve to be driven from the closed port position to the position permitting fluid flow.

In view of the foregoing there is provided a method for fluid treatment of a borehole, the method comprising: providing a wellbore tubing string apparatus according to one of the various embodiments of the invention; running the tubing string into a wellbore and to a desired position in the wellbore; conveying an actuating device to actuate the first sleeve and generate thereon a ball stop; conveying a sleeve shifting ball to land on the ball stop and create a fluid seal between the sleeve and the sleeve shifting ball; and increasing fluid pressure in the tubing string above the sleeve shifting ball to move the first sleeve to open a port through which borehole treatment fluid can be introduced to the borehole.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION OF VARIOUS EMBODIMENTS

Figure 1A:
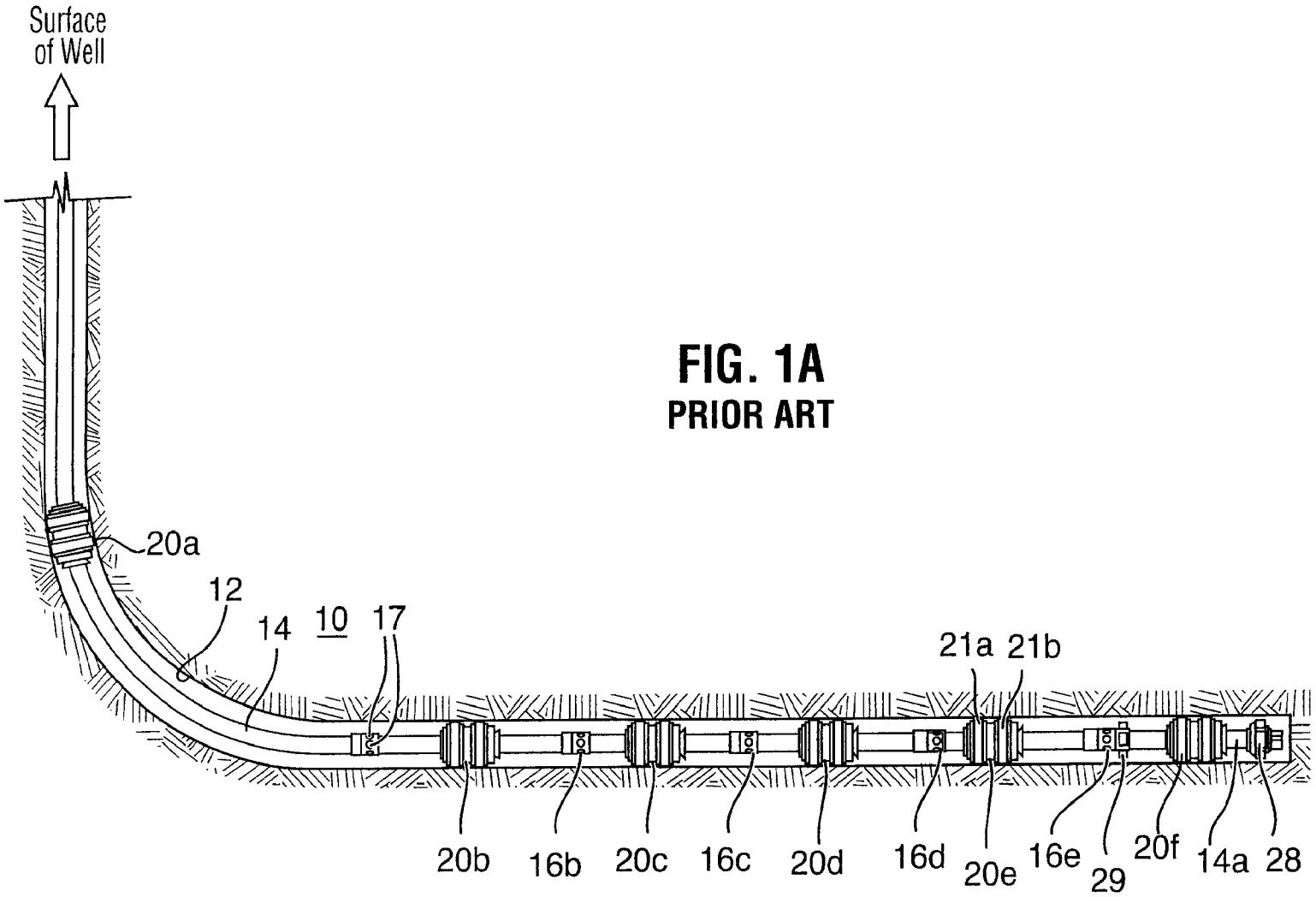
FIG. 1A PRIOR ART
FIG. 1A is a sectional view through a wellbore having positioned therein a prior art fluid treatment assembly.

The description that follows and the embodiments described therein, are provided by way of illustration of an example, or examples, of particular embodiments of the principles of various aspects of the present invention. These examples are provided for the purposes of explanation, and not of limitation, of those principles and of the invention in its various aspects. In the description, similar parts are marked throughout the specification and the drawings with the same respective reference numerals. The drawings are not necessarily to scale and in some instances proportions may have been exaggerated in order more clearly to depict certain features.

A wellbore sliding sleeve has been invented that is modified by the passage therethrough of a device that configures the sleeve to be driven by a sleeve shifting device while it was not previously configured, such that during the subsequent passage of a sleeve shifting device, the sleeve may be actuated by the sleeve shifting device. The sliding sleeve sub may be employed in a wellbore tubular string. In addition, a method and apparatus has been invented which provides for selective communication to a wellbore for fluid treatment using such a wellbore sliding sleeve. In one aspect of the invention the method and apparatus provide for staged injection of treatment fluids wherein fluid is injected into selected intervals of the wellbore, while other intervals are closed. In another aspect, the method and apparatus provide for the running in of a fluid treatment string, the fluid treatment string having ports substantially closed against the passage of fluid therethrough, but which are each openable by operation of a sliding sleeve when desired to permit fluid flow into the wellbore. The apparatus and methods of the present invention can be used in various borehole conditions including open holes, cased holes, vertical holes, horizontal holes, straight holes or deviated holes.

Figure 1B:
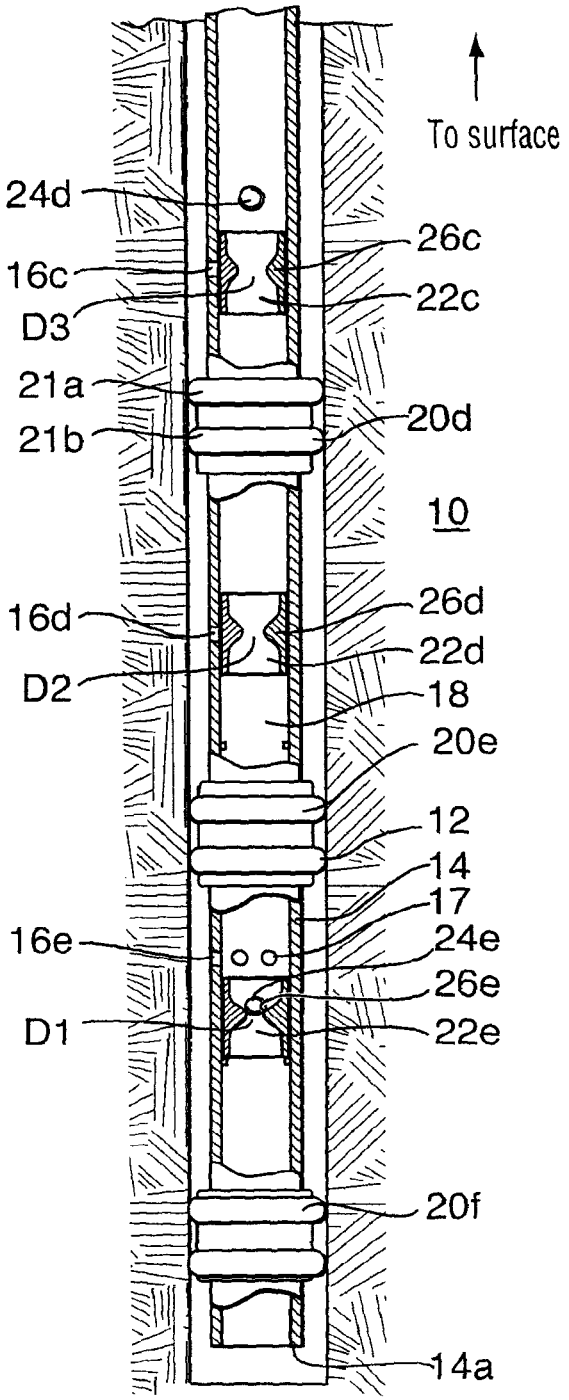
FIG. 1B PRIOR ART
FIG. 1B is an enlarged view of a portion of the wellbore of FIG. 1*a* with the fluid treatment assembly also shown in section.

Referring to FIGS. 1*a* and 1*b*, an example prior art wellbore fluid treatment assembly is shown, which includes sliding sleeves. While other string configurations are available using sliding sleeves in staged arrangements, in the assembly illustrated the sleeves are used to control flow through the string and the string can be used to effect fluid treatment of a formation 10 through a wellbore 12. The wellbore assembly includes a tubing string 14 having a lower end 14*a* and an upper end extending to surface (not shown). Tubing string 14 includes a plurality of spaced apart ported intervals 16*a* to 16*e* each including a plurality of ports 17 opened through the tubing string wall to permit access between the tubing string inner bore 18 and the wellbore. Any number of ports can be used in each interval. Ports can be grouped in one area of an interval or can be spaced apart along the length of the interval.

A packer 20*a* is mounted between the upper-most ported interval 16*a* and the surface and further packers 20*b* to 20*e* are mounted between each pair of adjacent ported intervals. In the illustrated embodiment, a packer 20*f* is also mounted below the lower most ported interval 16*e* and lower end 14*a* of the tubing string. The packers are disposed about the tubing string and selected to seal the annulus between the tubing string and the wellbore wall, when the assembly is disposed in the wellbore. The packers divide the wellbore into isolated segments wherein fluid can be applied to one segment of the well, but is prevented from passing through the annulus into adjacent segments. As will be appreciated the packers can be spaced in any way relative to the ported intervals to achieve a desired interval length or number of ported intervals per segment. In addition, packer 20*f* need not be present in some applications.

The packers may take various forms. Those shown are of the solid body-type with at least one extrudable packing element, for example, formed of rubber. Solid body packers including multiple, spaced apart packing elements 21*a*, 21*b* on a single packer are particularly useful especially, for example, in open hole (unlined wellbore) operations. In another embodiment, a plurality of packers is positioned in side by side relation on the tubing string, rather than using one packer between each ported interval.

Sliding sleeves 22*c* to 22*e* are disposed in the tubing string to control the opening of the ports. In this embodiment, a sliding sleeve is mounted over each ported interval to close them against fluid flow therethrough, but can be moved away from their positions covering the ports to open the ports and allow fluid flow therethrough. In particular, the sliding sleeves are disposed to control the opening of the ported intervals through the tubing string and are each moveable from a closed port position, wherein the sleeve covers its associated ported interval (as shown by sleeves 22*c* and 22*d*) to a position away from the ports wherein fluid flow of, for example, stimulation fluid is permitted through ports 17 of the ported interval (as shown by sleeve 22*e*). In other embodiments, the ports can be closed by other means such as caps or second sleeves and can be opened by the action of the sliding sleeves 22*c* to 22*e* to break open or remove the caps or move the second sleeves.

The assembly is run in and positioned downhole with the sliding sleeves each in their closed port position. The sleeves are moved to their open position when the tubing string is ready for use in fluid treatment of the wellbore. The sleeves for each isolated interval between adjacent packers may be opened individually to permit fluid flow to one wellbore segment at a time, in a staged, concentrated treatment process.

In one embodiment, the sliding sleeves are each moveable remotely from their closed port position to their position permitting through-port fluid flow, for example, without having to run in a line or string for manipulation thereof. In one embodiment, the sliding sleeves are each actuated by a device, such as a ball 24*e* (as shown), which includes a ball, a dart or other plugging device, which can be conveyed by gravity or fluid flow through the tubing string. The device engages against the sleeve. For example, in this case ball 24*e* engages against sleeve 22*e*, and, when pressure is applied through the tubing string inner bore 18 from surface, ball 24*e* stops in the sleeve and creates a pressure differential above and below the sleeve which drives the sleeve toward the lower pressure side.

In the illustrated embodiment, the inner surface of each sleeve which is open to the inner bore of the tubing string defines a seat 26*e* onto which an associated plug such as a ball 24*e*, when launched from surface, can land and seal thereagainst. When the ball seals against the sleeve seat and pressure is applied or increased from surface and a pressure differential is set up which causes the sliding sleeve on which the ball has landed to slide to a port-open position. When the ports of the ported interval 16*e* are opened, fluid can flow therethrough to the annulus between the tubing string and the wellbore and thereafter into contact with formation 10.

Each of the plurality of sliding sleeves has a different diameter seat and therefore each accept different sized balls. In particular, the lower-most sliding sleeve 22*e* has the smallest diameter D1 seat and accepts the smallest sized ball 24*e* and each sleeve that is progressively closer to surface has a larger seat. For example, as shown in FIG. 1*b*, the sleeve 22*c* includes a seat 26*c* having a diameter D3, sleeve 22*d* includes a seat 26*d* having a diameter D2, which is less than D3 and sleeve 22*e* includes a seat 26*e* having a diameter D1, which is less than D2. This provides that the lowest sleeve can be actuated to open first by first launching the smallest ball 24*e*, which can pass through all of the seats of the sleeves closer to surface but which will land in and seal against seat 26*e* of sleeve 22*e*. Likewise, penultimate sleeve 22*d* can be actuated to move away from ported interval 16*d* by launching a ball 24*d* which is sized to pass through all of the seats closer to surface, including seat 26*c*, but which will land in and seal against seat 26*d*.

Lower end 14*a* of the tubing string can be open, closed or fitted in various ways, depending on the operational characteristics of the tubing string that are desired. In the illustrated embodiment, end 14*a* includes a pump out plug assembly 28. Pump out plug assembly acts to close off end 14*a* during run in of the tubing string, to maintain the inner bore of the tubing string relatively clear. However, by application of fluid pressure, for example at a pressure of about 3000 psi, the plug can be blown out to permit actuation of the lower most sleeve 22*e* by generation of a pressure differential. As will be appreciated, an opening adjacent end 14*a* is only needed where pressure, as opposed to gravity, is needed to convey the first ball to land in the lower-most sleeve. Alternately, the lower most sleeve can be hydraulically actuated, including a fluid actuated piston secured by shear pins, so that the sleeve can be opened remotely without the need to land a ball or plug therein.

In other embodiments, not shown, end 14*a* can be left open or can be closed for example by installation of a welded or threaded plug.

Centralizer 29 and/or other standard tubing string attachments can be used, as desired.

In use, the wellbore fluid treatment apparatus, as described with respect to FIGS. 1A and 1B, can be used in the fluid treatment of a wellbore. For selectively treating formation 10 through wellbore 12, the above-described assembly is run into the borehole and the packers are set to seal the annulus at each location creating a plurality of isolated annulus zones. Fluids can then pumped down the tubing string and into a selected zone of the annulus, such as by increasing the pressure to pump out plug assembly 28. Alternately, a plurality of open ports or an open end can be provided or lower most sleeve can be hydraulically openable. Once that selected zone is treated, as desired, ball 24*e* or another sealing plug is launched from surface and conveyed by gravity or fluid pressure to seal against seat 26*e* of the lower most sliding sleeve 22*e*, this seals off the tubing string below sleeve 22*e* and opens ported interval 16*e* to allow the next annulus zone, the zone between packer 20*e* and 20*f* to be treated with fluid. The treating fluids will be diverted through the ports of interval 16*e* exposed by moving the sliding sleeve and be directed to a specific area of the formation. Ball 24*e* is sized to pass through all of the seats, including seats 26*c*, 26*d* closer to surface without sealing thereagainst. When the fluid treatment through ports 16*e* is complete, a ball 24*d* is launched, which is sized to pass through all of the seats, including seat 26*c* closer to surface, and to seat in and move sleeve 22*d*. This opens ported interval 16*d* and permits fluid treatment of the annulus between packers 20*d* and 20*e*. This process of launching progressively larger balls or plugs is repeated until all of the zones are treated. The balls can be launched without stopping the flow of treating fluids. After treatment, fluids can be shut in or flowed back immediately. Once fluid pressure is reduced from surface, any balls seated in sleeve 2 seats 26*c-e* can be unseated by pressure from below to permit fluid flow upwardly therethrough.

The apparatus is particularly useful for stimulation of a formation, using stimulation fluids, such as for example, acid, gelled acid, gelled water, gelled oil, $CO_2$, nitrogen and/or proppant laden fluids. The apparatus may also be useful to open the tubing string to production fluids.

While the illustrated tubing string includes five ported intervals controlled by sleeves, it is to be understood that the number of ported intervals in these prior art assemblies can be varied. In a fluid treatment assembly useful for staged fluid treatment, for example, at least two openable ports from the tubing string inner bore to the wellbore must be provided such as at least two ported intervals or an openable end and one ported interval. As the staged sleeve systems become more developed, there is a desire to use greater numbers of sleeves. It has been found, however, that size limitations do tend to limit the number of sleeves that can be installed in any tubular string. For example, in one example ID tubular, using sleeves with a ¼" seat size graduation, balls from 1¼" to 3¾" are reasonable and each size ball can only be used once. This limits the number of sleeves in any tubular for this tubular size to eleven and has a lower region of the tubing string being reduced in ID to form a seat capable of catching a 1¼" ball.

Figures 2A, 2B, 2C, 2D:
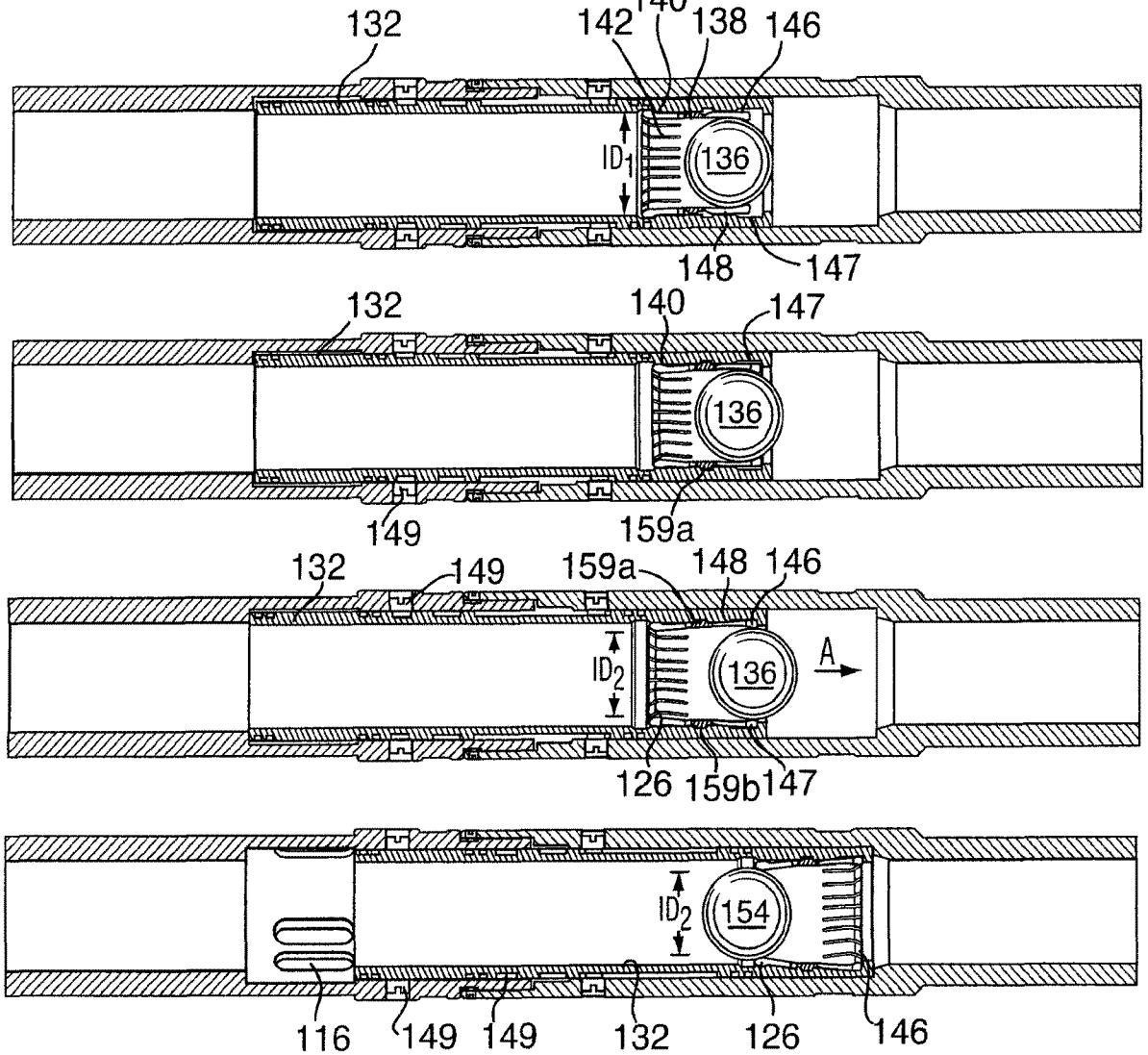
FIGS. 2A to 2D are sequential sectional views through a sleeve valve sub according to an aspect of the present invention.

A sleeve according to the present invention may be useful to allow an increased number of sleeves in any tubular string, while maintaining a substantially open inner diameter along a considerable length of the tubing string. For example, using sleeves according to the present invention more than one sleeve can be provided with a similar diameter ball stop. The sleeves however, may be installed in a condition where the ball stop, which may further act as a valve seat, is not exposed but the sleeve can be configurable downhole to have a valve seat formed thereon which is sized to catch and retain sealing devices. Referring to FIGS. 2A to 2D, a sleeve system is shown including a sliding sleeve 132 that is actuable to be reconfigured from a form not including a sleeve shifting ball stop (FIG. 2A) to a form defining a sleeve shifting ball stop 126, which in the illustrated embodiment also acts as a ball seat providing the sealing area against which the ball can act (FIG. 2B). In the condition of FIG. 2A, prior to a ball stop being formed, a ball, which is to be understood to include sleeve shifting devices such as balls, darts, plugs, etc., may pass therethrough. However, after being actuated to form a ball stop 126, the ball that previously passed through would be caught in the ball stop and create a fluid seal in the sleeve such that a pressure differential can be established thereabout.

The sleeve may be actuated to reconfigure by various means such as by moving an actuator device 136 through the inner bore of the sleeve. The sleeve system may include a mechanical driver driven by the actuator device engaging on the mechanical driver and acting upon it to drive the formation of a valve seat. In another embodiment, the sleeve system may include a non-mechanical driver such as a sensor that is actuated by means other than physical engagement to drive the formation of a valve seat. A sensor may respond to an actuator device such as one emitting radio signals, magnetic forces, etc. Such an actuator device signals the sensor to form a ball stop on the sleeve, as it communicates with the sensor the sleeve. The actuator device may be operated from surface or may be passes through the tubing string to communicate with the sensor.

In one embodiment, for example such as that shown in FIG. 2, sleeve 132 may be installed in a tubing section 150 and positioned to be moveable between a position (FIGS. 2A-2D) covering and therefore blocking flow through ports 116 through the section wall and a position away from ports such that they are open for fluid flow therethrough (FIG. 2D).

Sleeve 132 may include a mechanical driver such as including a collet 138 slidably mounted on sleeve 132 and operating relative to a section 140 of tapering inner diameter of the sleeve. As such collet 138, including fingers 142 can be originally mounted in the sleeve with the fingers having an inner diameter between them of $ID_1$. However, the relative position of the fingers can be reconfigured by moving the collet along a tapering portion of tapered section 140 to drive collet fingers 142 together and radially inwardly to define an opening through the collet fingers having a second inner diameter $ID_2$ smaller than the original inner diameter $ID_1$. When constricted, fingers 142 together form seat 126 defining the inner diameter $ID_2$.

In such an embodiment, a ball or other sealing device can be used as an actuator to drive the collet, along tapered section 140. For example, the mechanical driver can include a catcher to catch an actuator temporarily to drive movement of the collet. In the illustrated embodiment, actuator ball 136 can be passed through the sleeve and is sized to land in a catcher 146 (FIG. 2A) connected to the collet in order to engage, at least temporarily in the catcher and move the collet. Catcher 146 can include a valve seat sized to catch ball 136 or other sealing device to allow the collet to be moved axially along by, for example, increasing pressure behind the ball while the ball is held in the catcher. Catcher 146 in the illustrated embodiment includes a plurality of collet fingers that are biased and retained inwardly to create the valve seat. The catcher can also act against a tapered or stepped portion such that while the catcher, and in particular the fingers thereof, are initially held against radial expansion by being located in a smaller diameter region 148 in the sleeve (FIG. 2A), catcher 146 can expand once the ball moves the catcher fingers over a larger diameter section 147 (FIGS. 2B and 2C). When in the position where catcher fingers can expand to release the ball (arrow A), the collet fingers have been driven onto tapered section 140 to form seat 126. Collet 138 can be locked in this position so that it cannot advance further nor return to the run in position. For example, collet 138 can include a lock protrusion 149*a* that lands in a recess 149*b* in sleeve 132. As such, any force applied to collet 138 can be transmitted to sleeve 132.

Collet 138 can be mounted in sleeve 132 such that when driven into the second configuration, the collet 138 cannot move further such that in this way any further forces against collet are transferred to sleeve 132. For example, collet 138 can include a lock protrusion 159*a* that lands in a recess 159*b* in sleeve 132. As such, any force applied to collet 138 can be transmitted to sleeve 132.

After the collet is moved to constrict fingers 142 to form an opening of $ID_2$, a second ball 154 or plug having a diameter greater than $ID_2$ can be launched from surface and can land and seal against seat 126 formed at the constricted opening between collet fingers 142. The collet can then be driven along with the sleeve by increasing fluid pressure behind the ball to drive the ball to act against the seat. It will be appreciated that prior to the formation of the opening of $ID_2$, that same ball would have passed through the sleeve without catching on fingers 142.

The relative ease of movement between collet 138 and sliding sleeve 132 can be selected such that the collet moves preferentially over the movement of the sliding sleeve. For example, shear screws 149 or frictional selections can be used between the sleeve and the tubular 150 in which the sleeve is positioned to ensure that movement of the sleeve is restricted until certain selected pressures are reached.

Movement of sleeve 132 exposes ports 116 such that fluid can be forced out of the tubular above ball 154.

Figure 2E:
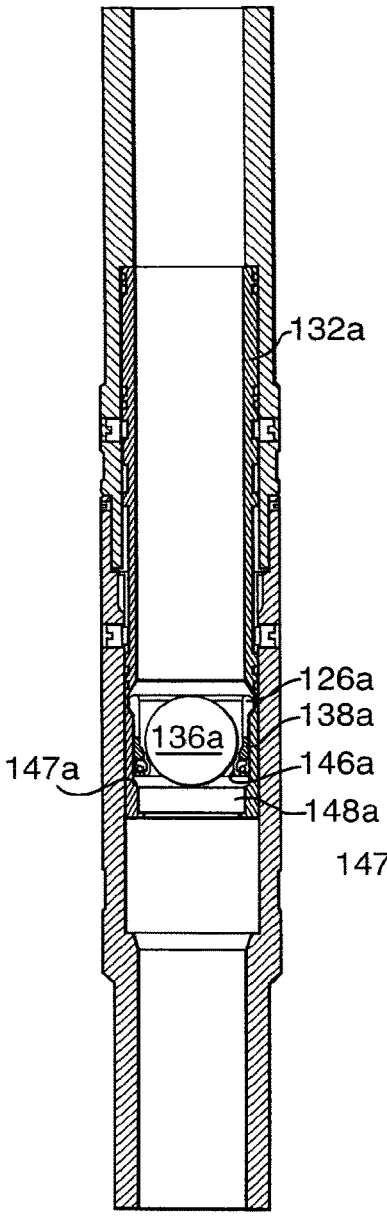
FIGS. 2E and 2F are a sectional views through a sleeve valve sub according to an aspect of the present invention.
Figure 2F:
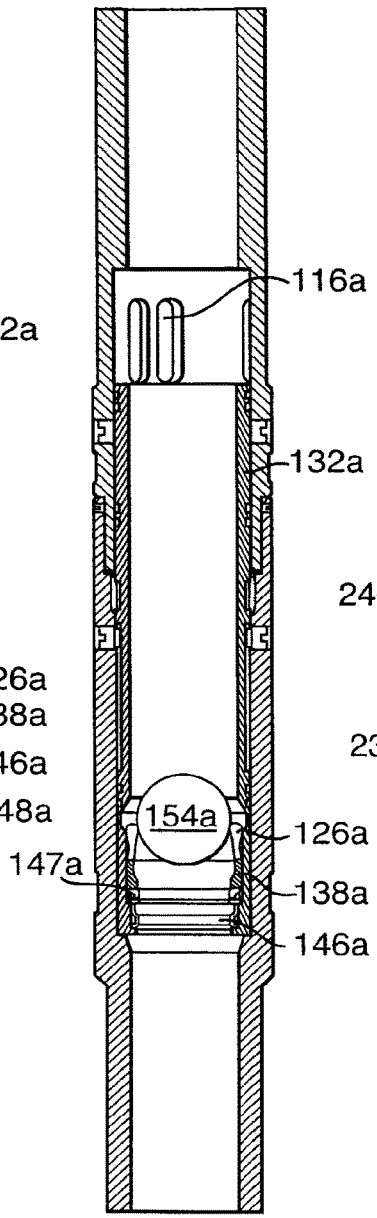

Of course, other types of ball stops and catchers can be employed as desired. For example, in another embodiment as shown in FIGS. 2E and 2F, another form of catcher is employed in the driver. The catcher in this illustrated embodiment includes a shear out actuation ring 146*a* secured to collet 138*a*. The shear out actuation ring is secured to the collet with an interlock suitable to catch an actuator ball 136*a* (FIG. 2E) and move the collet in response to a pressure differential about the ball, but when the collet shoulders against return 147*a* on sleeve 132*a*, the interlock will be overcome and actuation ring 146*a* will be sheared from the collet and expand into a recess 148*a* to let ball 136*a* pass and open the bore through the sleeve.

When shear out actuation ring 146*a* is sheared from the collet and expanded into recess 148*a*, the collet fingers 126*a* have been driven onto tapered section 140*a* to form the sleeve shifting seat into which a sleeve shifting ball 154*a* can land and seal (FIG. 2F). Collet 138*a* being shouldered against return 147*a*, directs any force applied thereagainst by ball 154*a* and fluid pressure to sleeve 132*a*, which can slide to expose ports 116*a*.

Figure 3:
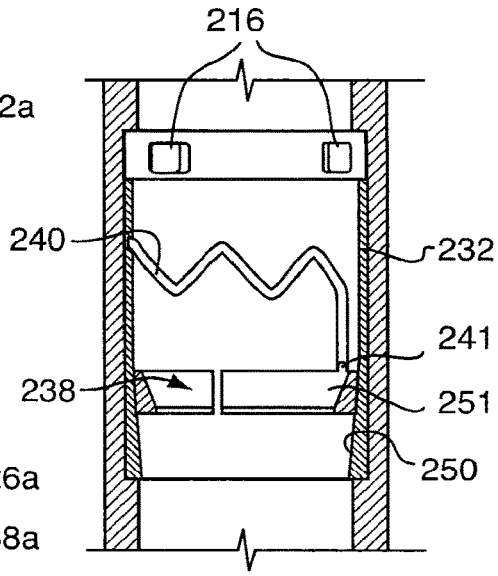
FIG. 3 is a sectional view through another sleeve according to an aspect of the invention.

In one embodiment, the driver may include a device to only drive the formation of a valve seat after a plurality of actuations. For example, in one embodiment, the driver may include a walking J-type controller that is advanced through a plurality of stages prior to actually finally driving configuration of the valve seat. As shown in FIG. 3, for example, a sleeve 232 may include a walking J keyway 240 in which the driver 238 is installed by a key 241. Actuators, such as a plurality of balls may be passed by the driver to each advance it one position through the various positions in keyway 240 before finally allowing the driver to move into a position to form a valve seat. For example, after passing out of the final stage of the keyway, the driver can be allowed to move along a frustoconical interval 250 to constrict into a valve seat that retains a plug of a selected size to create a back pressure to push the sleeve through the tubing string and expose ports 216. In one embodiment, for example as shown, the driver may include a radially compressible and resilient C ring 251 that can be compressed when being forced axially along a tapering diameter of frustoconical surface 250 to form a valve seat, which is ring 251 compressed to reduce its inner diameter. It is noted in this illustrated embodiment that the same structure as a catcher of the driver and as the eventual valve seat, depending on the stage of operation.

Figure 3A:
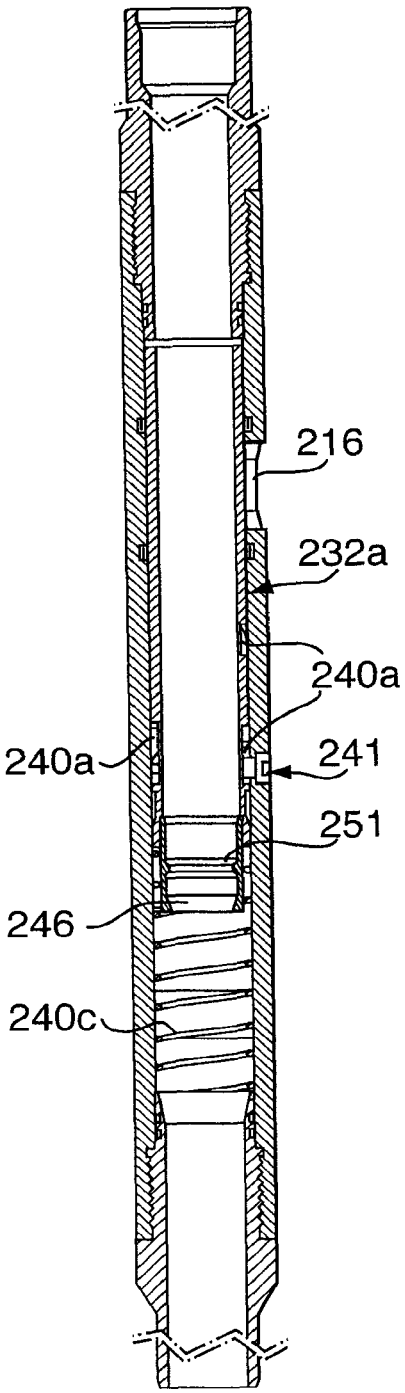
FIGS. 3A to 3D are sequential sectional views through another sleeve valve sub according to an aspect of the present invention.
Figure 3B:
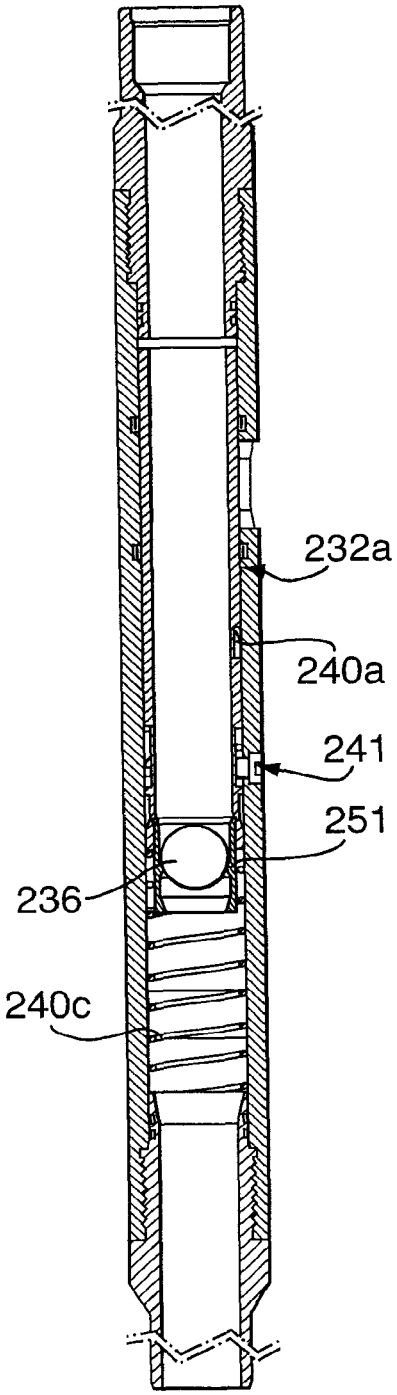
Figure 3C:
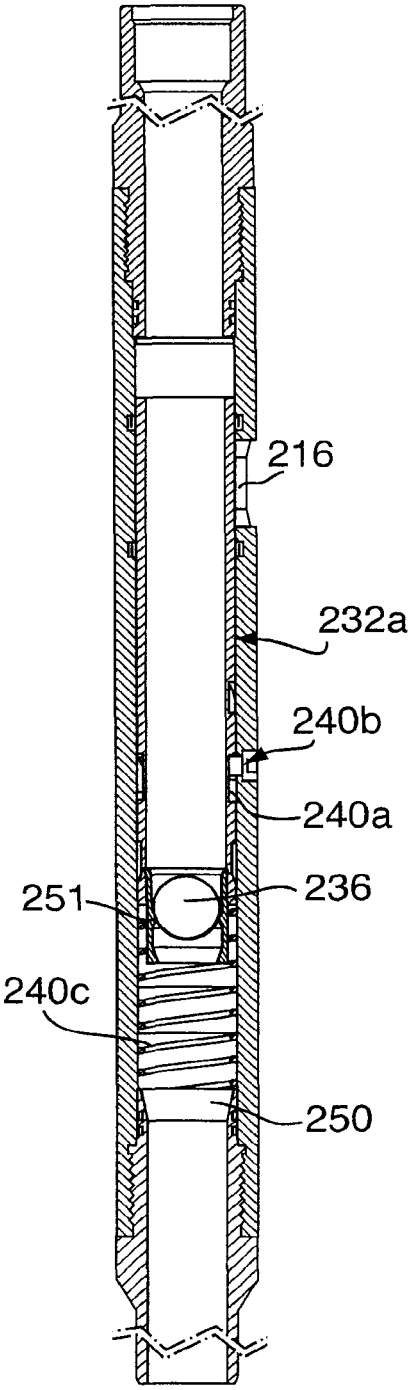
Figure 3D:
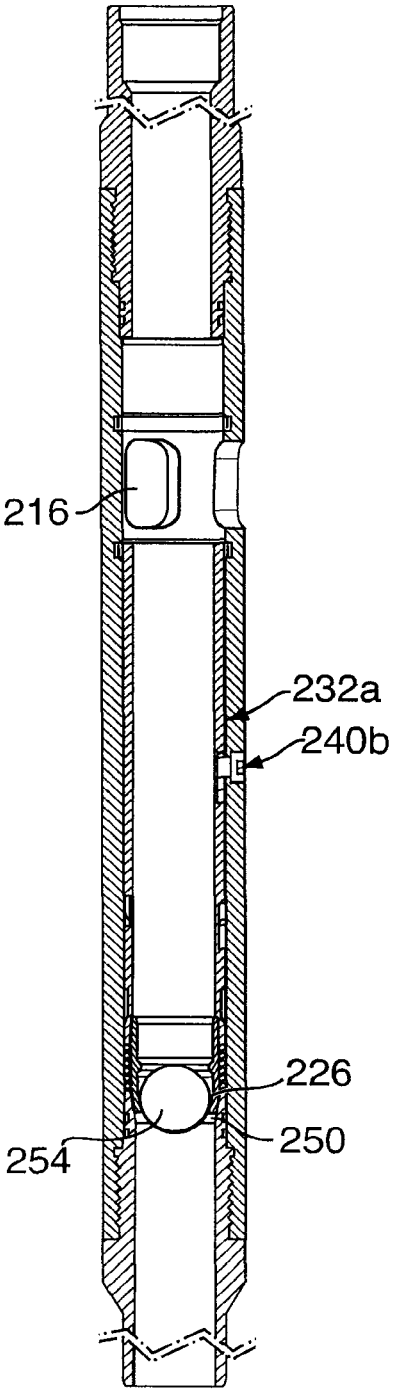
Figure 3E:
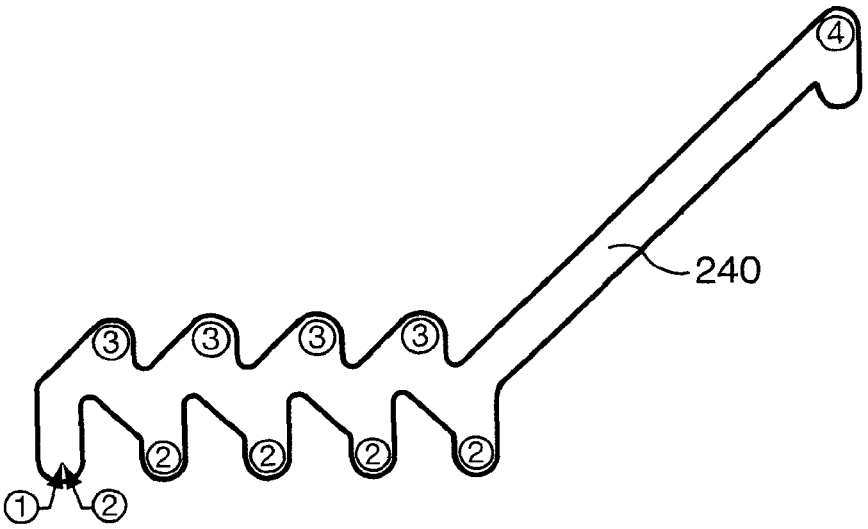
FIG. 3E is a plan view of a J keyway slot useful in the invention.
Figure 3F:
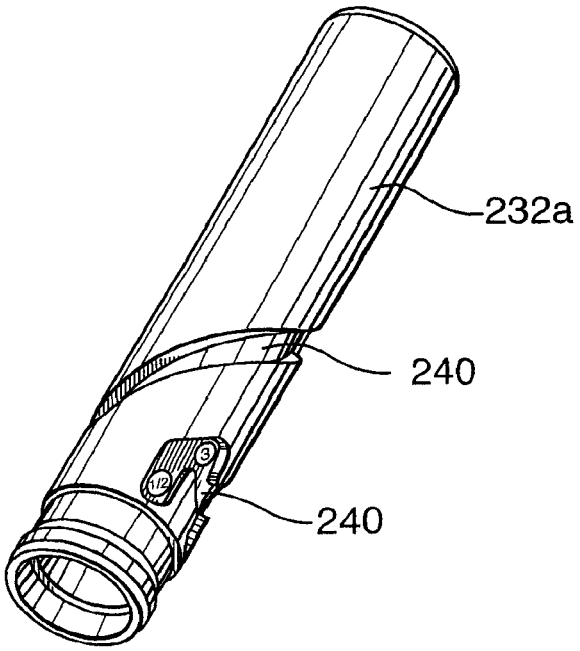
FIG. 3F is an isometric view of a sleeve useful in the invention.

In another embodiment, as shown in FIGS. 3A to 3F, the driver can be secured or formed integral with the sleeve valve 232*a* such that movement of the sleeve causes formation of the ball stop, which here is embodied as a single valve seat 226. In particular in this illustrated embodiment, sleeve valve 232*a* includes a walking J keyway 240*a* on its outer surface in which rides a key 241*a* that is secured to the sub housing 251*a*. Actuators, such as a plurality of balls 236 may be passed by the driver to each advance it one position from a first, run in position 1 through the various positions 2, 3 in keyway 240*a* (FIGS. 3B and 3C), as assisted by spring 240*c*, before finally allowing the driver to move into a position 4 to form a valve seat 226 (FIG. 3D). For example, when passing into the final position 4 in the keyway, the sleeve is driven to move a compressible seat 226 along a frustoconical interval 250 that compresses the valve seat such that it has a reduced diameter and can retain a sleeve shifting plug 254 of a selected size when it is introduced to the sleeve. When landed in and sealed against seat 226, plug 254 creates a back pressure to push the sleeve through the tubing string and expose ports 216*a*.

In one embodiment, for example as shown, the driver may include a first deformable ball seat 251 that holds a ball 236 temporarily and for enough time to move the sleeve against the bias in spring 240*c* such that the sleeve moves over key 241*a* from position 2 (FIG. 3B) to position 3 (FIG. 3C). However, the seat 251 deforms elastically when a certain pressure differential is reached to allow the ball to pass and spring 240*c* can act again on the sleeve to bias it to the next position 2, until finally it moves into position 4. The number of ball driven positions 3 in keyway slot 240*a* determine the number of cycles that sleeve moves through before moving into final position 4, when valve seat 226 is formed.

In embodiments where cycling is of interest, indexing keyways may be employed or, alternately, timers or staged locks, such as latches, stepped regions, c-rings, etc., may be used to allow the sleeve to cycle through a number of passive positions before arriving at an active position, wherein a seat forms. Of course, the indexing keyway such as that shown in FIG. 3A provides a reliable yet simple solution where the sleeve must pass through a larger number (more than two or three) cycles before arriving at the active state.

Figure 4:
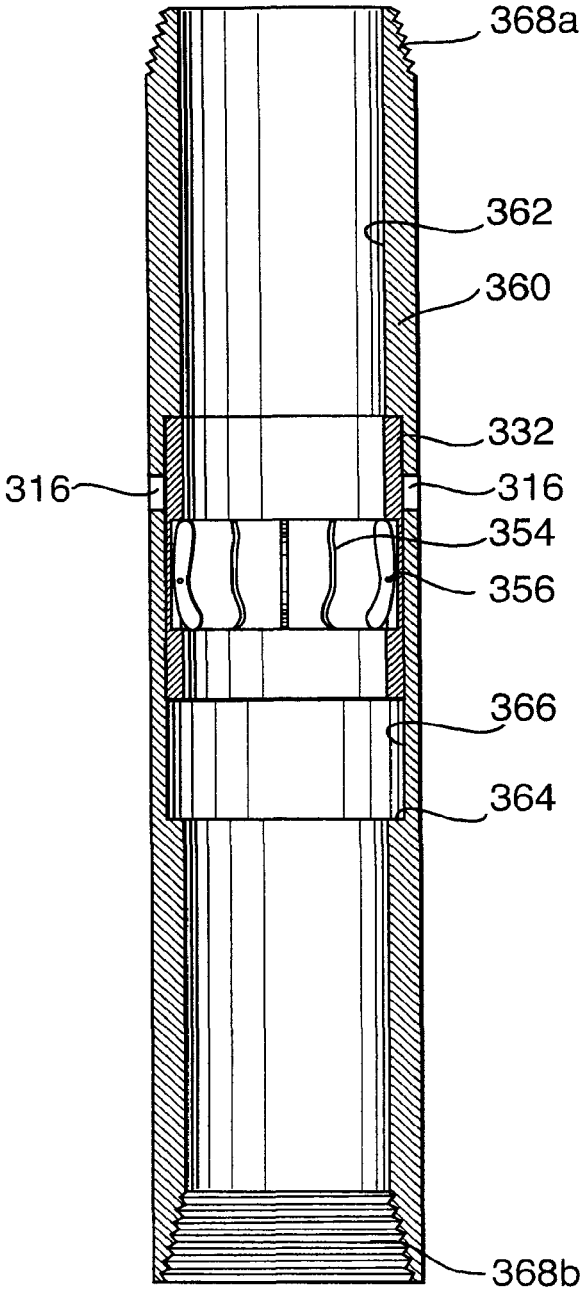
FIG. 4 is a sectional view through a sleeve valve sub according to an aspect of the present invention.

The drivers for the seat can be actuated by actuating devices, passing the sleeve either on the way down through the tubular, toward bottom hole, or when the actuating device is being reversed out of the well. FIG. 4 shows another possible embodiment that includes a driver that is actuated by an actuating device passing up hole therepast, as when the actuating device is being reversed out of the well. As shown, for example, a sliding sleeve 332 may include a driver that is mechanically driven and includes a plurality of dogs 354 that are initially positioned to allow passage of an actuating device as it passes downhole through the inner diameter 362 of a sub in which the sleeve is installed. However, the dogs are configured such that same device operates to drive the dogs to a second position, forming a valve seat of a selected size when that actuating device is reversed out of the tubular string and moves upwardly past the sleeve. For example, the dogs may be pivotally connected by pins 356 to the sleeve and may be normally capable of pivoting to allow a ball to pass in one direction but may be driven to pivot to, and remain in, a second position when that ball passes upwardly therepast, the second position forming a valve seat for retaining a second ball when it is launched from surface. The second ball sized to land in and seal against the formed valve seat such that it a pressure differential can be established above and below the second ball to drive the sleeve along its recess 366 in the sub 360 until it lands against wall 364 and in this position exposes ports 316 previously covered by the sleeve.

In another embodiment, rather than being mechanically driven to reconfigure, such as those embodiments described hereinbefore, the driver may be non-mechanically driven as by electric or magnetic signaling to drive formation of a ball stop, such as a valve seat. For example, a device emitting a magnetic force may be dropped or conveyed through the tubing string to actuate the drivers to configure a ball stop on the sleeve or sleeves of interest.

In some embodiments, such as is shown in FIG. 3A-3D, movement of the sleeve valve drives formation of the ball stop. In other embodiments, such as in FIGS. 2 and 4, the movement of components to form the ball stop may be separate from movement of the sliding sleeve such that the sleeve seals do not have to unseat during formation of the ball stop. Another such embodiment is shown in FIG. 5, which shows a multi-acting hydraulic drive system.

The illustrated multi-acting hydraulic drive system of FIGS. 5A to 5D utilizes a driver that allows a staged formation of a collet ball seat 426 to drive movement of a sleeve 432 to open ports 416. The multi-acting hydraulic drive system is run in initially in the un-shifted position (FIG. 5A) with the fracturing port openings 416 in the outer housing 450 of the tubing string segment isolated from the inner bore of the tubing string segment by a wall section of sleeve 432. O-rings 433 are positioned to seal the interface between sleeve 432 and housing 450 on each side of the openings. The inner sleeve is held within the outer housing by shear pins 449 that thread through the external housing and engage a slot 449*a* machined into the outer surface of the sleeve. The range of travel of the inner sleeve along housing 450 is restricted by torque pins 451.

A driver formed as a second sleeve 438 is held within and pinned to the inner sleeve by shearable pins 459. The second sleeve carries a collet ball seat 426 that is initially has a larger diameter IDL and, downstream thereof, a yieldable ball seat 446 that is a smaller diameter IDS. This configuration allows selection of a ball 436 that can be introduced and pass through the collet ball seat, but land in and be stopped by the yieldable ball seat. When landed (FIG. 5B), the ball isolates the upstream tubing pressure from the downstream tubing pressure across seat 446 and if the upstream pressure is increased by surface pumping, the pressure differential across the yieldable seat develops a force that exceeds the resistive shear force of the pins 459 holding the second sleeve within inner sleeve 432. As the second sleeve moves, collet ball seat 426 then travels a short distance within the inner sleeve and moves into an area of reduced diameter 440 resulting in a decrease in diameter to IDS1, which is less than IDL, across the collet ball seat. With a further increase in pressure, the differential force developed will be sufficient to push ball 436 through the yieldable ball seat and the ball will travel (arrows B, FIG. 5C) down to seat in and actuate a sliding sleeve-valve (not shown) below. The yieldable seat can be formed as a constriction in the material of the secondary sleeve and be formed to be yieldable, as by plastic deformation at a particular pressure rating. In one embodiment, the yieldable seat is a constriction in the sleeve material with a hollow backside such that the material of the sleeve protrudes inwardly at the point of the constriction and is v-shaped in section, but the material thinning caused by hollowing out the back side causes the seat to be relatively more yieldable than the sleeve material would otherwise be.

Movement of the secondary sleeve is stopped by a return 458 on the inner sleeve forming a stop wall. The stop wall causes any further downward force on sleeve 438 to be transmitted to inner sleeve 432.

Figure 5A:
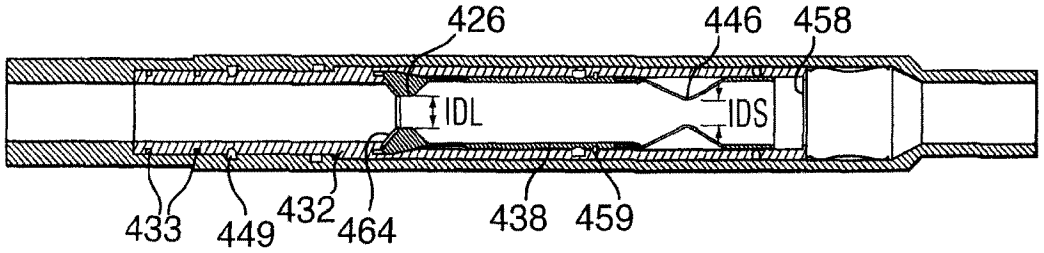
FIGS. 5A to 5D are sequential sectional views through another sleeve valve sub according to an aspect of the present invention.
Figure 5B:
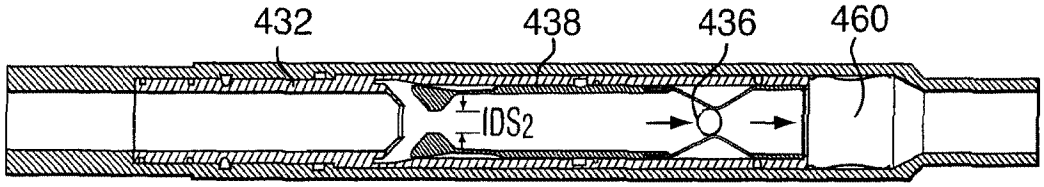
Figure 5C:
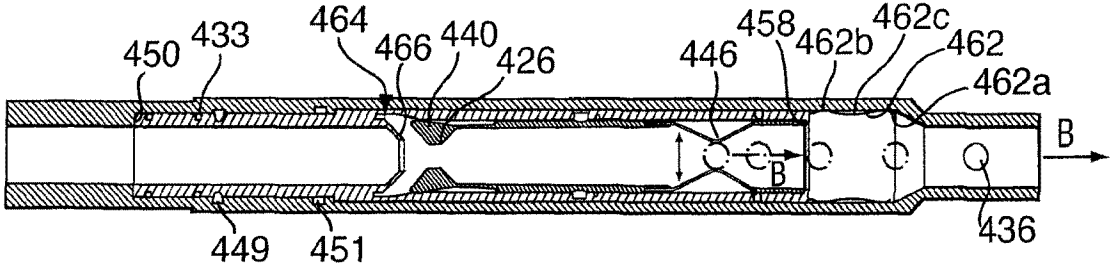
Figure 5D:
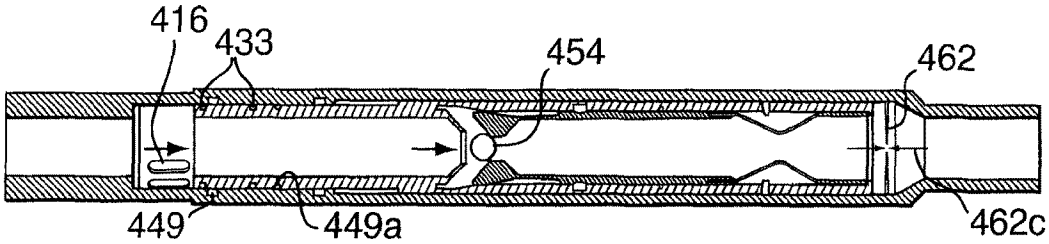

When it is desired to open ports 416 of the multi-acting hydraulic drive system, a ball 454 is pumped down to the now formed collet ball seat 426 (FIG. 5D). Ball 454 is selected to be larger than IDS1 such that it seals off the upstream pressure from the downstream pressure. Ball 454 may be the same size as ball 436. Increasing the upstream pressure P creates a pressure differential across ball 454 and seat 426 that acts on the inner sleeve and results in a force that is resisted by the shear pins 449 holding the inner sleeve in place. When this force on the inner sleeve exceeds the resistive force of the shear pins 449, the pins shear off and the inner sleeve slides down, as permitted by torque pins 451. Port openings 416 are then open allowing the frac string fluid to exit the tubing string and communicate with the annulus. The inner sleeve may prevented from closing again by a C-ring arrangement.

Since the string may include balls, such as ball 436 large enough to be stopped by seat 426, there may be a concern that employing such a multi-acting system may cause the tubing sting inner bore to be blocked when the lower balls return uphole with productions. As such, a ball stopper 460 may be attached below sleeve 432 that is operable to stop balls from flowing back through the multi-acting hydraulic drive system. A ball stopper may be operated in various ways. A ball stopper should not prevent balls from proceeding down the tubing string but stop balls from flowing back. The present ball stopper 460 is operated by movement of sleeve 432. When the sleeve is moved to open ports 416, it is useful to activate the ball stopper, as it is known that no further balls will be introduced therepast.

Figure 5E:
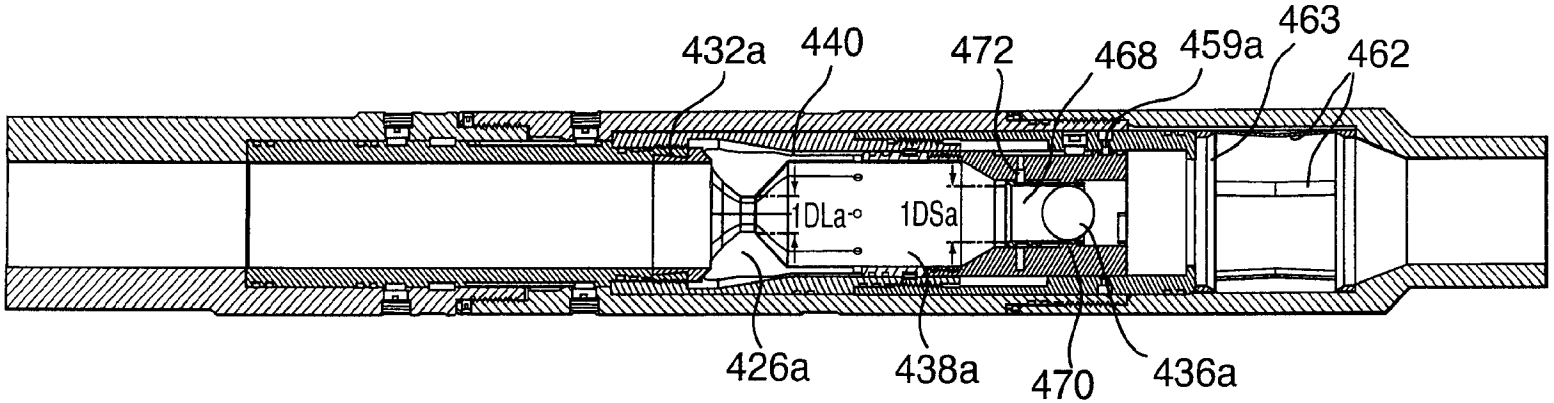
FIG. 5E is a sectional view through another sleeve according to an aspect of the invention.

In the illustrated embodiment, ball stopper 460 is compressed to close a set of fingers 462 to protrude into the inner bore and prevent balls of at least a size to lodge in seats 426 and 446 from moving therepast. The fingers are fixed at a first end 462*a* such that they cannot move along housing 450 and are free to move at an opposite end 462*b* adjacent to sleeve 432. The fingers are further biased, as by selected folding at a mid point 462*c*, to collapse inwardly when the inner sleeve moves against the free ends thereof. As best seen in FIG. 5E, the fingers 462 at least at their free ends can be connected by a ring 463 that urges the fingers to act as a unitary member and prevents the fingers from individually catching on structures, such as balls moving down therepast. Fingers 462 of the ball stopper prevent the original first leg balls from flowing back therepast, while allowing fluid flow. The ball stopper will generally be compressed into position before any back flow in the well. As such, then ball stopper tends to act first to prevent the balls below from reaching the seats of the secondary sleeve.

If there is concern that the ball stopper or fracs of the multi-acting hydraulic drive system of FIG. 5A will restrict production, the string housing 450 can be configured such that ports 416 also allow production from the lower stages to be produced through the upper sliding sleeve-valved fracturing port and into the annulus to bypass any flow constrictions such as balls that are trapped by the ball stopper.

In one embodiment, a ball seat guard 464 can be provided to protect the collet seat 426. For example, as shown, ball seat guard 464 can be positioned on the uphole side of collet seat 426 and include a flange 466 that extends over at least a portion of the upper surface of the collet seat. The guard can be formed frustoconically, tapering downwardly, to substantially follow the frustoconical curvature of the collet seat. Depending on the position of the guard, it may be formed as a part of the inner sleeve or another component, as desired. The guard may serve to protect the collet fingers from erosive forces and from accumulating debris therein. In one embodiment, the collet fingers may be urged up below the guard to force the fingers apart to some degree. After the collet moves to form the active seat (FIG. 5B), it may be separated from guard 464. In this position, guard tends to funnel fluids and ball 454 toward the center of collet seat 426 such that the figures of the collet continue to be protected to some degree.

As an example, a multi-acting hydraulic drive system as shown in FIGS. 5A to 5D, when run in may drift at 2.62" (IDS=2.62") and IDL is greater than that, for example about 2.75". A 2.75" ball 436 can pass seat 426, but land in yieldable seat 446 to shift collet seat 426 over the tapered area to create a new seat of diameter IDS2, which may be for example 2.62".

After ball 436 lands and shifts the second sleeve to form seat of diameter IDS2, seat 426 will yield and the ball will continue downhole. The second sleeve may shift to form the new seat at a pressure, for example, of 10 MPa, while the seat yields at 17 MPa. In this process, the multi-acting hydraulic drive system sleeve 432 does not move, the seals remain seated and unaffected and port openings 416 do not open. That ball 436 can thereafter land in a lower 2.62" seat below the repeater port and open the sleeve actuated by the seat to frac at that stage.

When it is desired to frac through openings 416, a second ball 454 is pumped down that is sized to land in and seal against seat 426. Such a ball may be, for example, 2.75", the same size as ball 436. Ball 454 will shift the sleeve 432 to open openings 416 and then fluids can be passed through openings 416. Sleeve may shift at a pressure greater than that used to yield seat 446, for example, 24 MPa, Ball stopper 450 has fingers sized to prevent passage of any balls, such as ball 436 which might block seats 426 or 446.

The multi-acting hydraulic drive system of FIG. 5A can be modified in several ways. For example, in one embodiment, as shown in FIG. 5E, the yieldable seat can be modified. For example, as shown in FIG. 5E, the yieldable seat can be formed as a sub sleeve 468, the yielding effect being restricted by a rear support 470 in the run in position. The multi-acting hydraulic drive system shift sleeve contains a collet ball seat 426*a* that is initially in a passive condition with a larger diameter IDLa and a further downstream the yieldable ball seat with sub sleeve 468 that is a smaller diameter IDSa. This configuration allows a ball 436*a* to pass through the collet ball seat and land in the yieldable ball seat and isolate the upstream tubing pressure from the downstream tubing pressure. The upstream pressure is increased by surface pumping and the pressure differential across the yieldable seat develops a force that exceeds the resistive shear force of pins 459*a* holding the second sleeve 438*a* within the inner sleeve 432*a*. As the second sleeve moves, collet ball seat 426*a* is moved with the sleeve a short distance along a tapering region 440*a* of the inner sleeve 432 resulting in the fingers of the collet to be compressed and a resulting decrease in diameter across the fingers forming the collet seat 426*a*. With further pressure differential the force developed will be sufficient to shear further pins 472 holding the sub sleeve to move the yieldable seat off the rear support 470 and the material of the sub sleeve can then expand and yield to allow the ball 436*a* to pass. The yieldable seat can be formed as a constriction in the material of the sub sleeve and be formed to be yieldable, as by plastic deformation at a particular pressure rating. In one embodiment, the yieldable seat is a thin sleeve material. In another embodiment, the yieldable seat is a plurality of collet fingers with inwardly turned tips forming the constriction.

As noted previously, the ball stops and sealing areas of the driver and shifting sleeve can be formed in various ways. In some embodiments, the ball stops and sealing areas are combined as seats. In another embodiment, as shown in FIG. 6, the ball stop can be provided separately, but positioned adjacent.

Figure 6A:
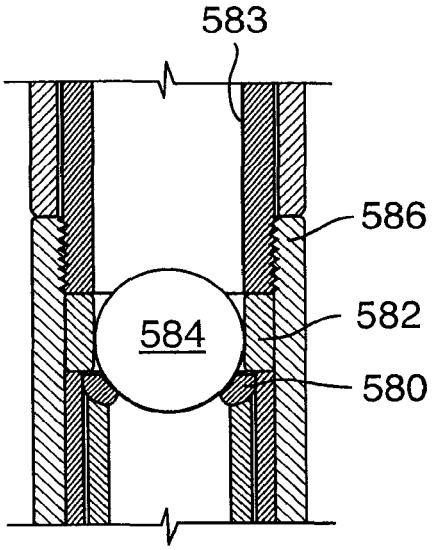
FIG. 6A is a sectional view through another sleeve according to an aspect of the invention.
Figure 6B:
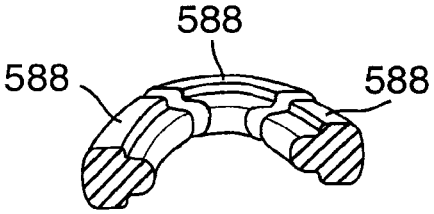
FIG. 6B is an isometric view of a split ring assembly useful in the present invention.
Figure 6C:
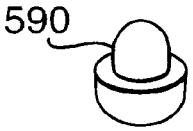
FIG. 6C is an isometric view of a spring biased detent pin useful in the present invention.

With reference to FIG. 6A, for example, a seat effect to drive a sleeve may be formed by a ball stop 580 and an adjacent sealing area 582. The ball stop creates a region of constricted diameter along a inner bore 583 that can retain and hold a ball 584 in a position in the inner diameter, for example of a sleeve 586. The sealing area is positioned adjacent the ball stop and formed to create a seal with the ball when it is retained on the ball stop such that pressure differential can be established across the sealing area when a ball is positioned therein.

The sealing area may be non-deformable or deformable. Because the sealing area is more susceptible to damage that creates failure, however, sealing area may be made non-deformable if it is not desired to introduce breaks or yieldability in the surface thereof. The ball stop may be non-deformable or deformable as desired, such that it can be used in the driver or in a formable seat. Deformable options may include expandable split rings (FIGS. 6B and 6E) including a number of ring segments 588 arranged in an annular arrangement, annularly installed ball bearing type detent pins 590 (FIG. 6C), a collet 592 (FIG. 6D) etc.

Figure 6D:
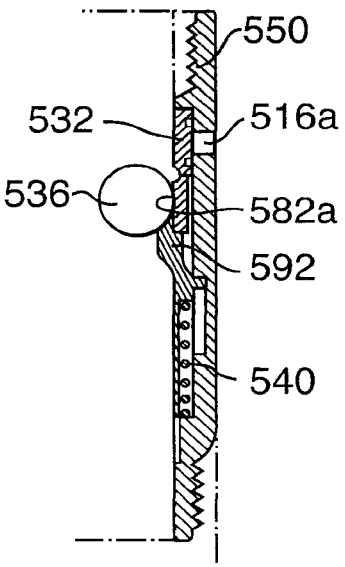
FIG. 6D is a sectional view through another sleeve according to an aspect of the invention.

This arrangement of ball stop and adjacent sealing area may be employed, for example, in a sleeve configured to allow shifting to move through several passive stages and then move to active stage to be operable to actually shift the sleeve. For example, as shown in FIG. 6D, a sleeve valve 532 is shown mounted in and positioned to cover ports 516*a* through a tubular housing 550. Sleeve 532 carries a collet 592 positioned adjacent a sealing area 582*a*. Collet 592 rides in a keyway that permits the collet, as driven by force applied by sealing of balls 536, to move between ball stop positions and expanded, yieldable positions. The movement through keyway is driven by spring 540. The keyway leads the collet to a final active stage, where it becomes locked in position on sleeve 532 adjacent to sealing surface 582*a*. In the active position, the collet holds a final ball against sealing area 582*a* to create a pressure differential to move sleeve 532 away from ports 516.

Figure 6E:
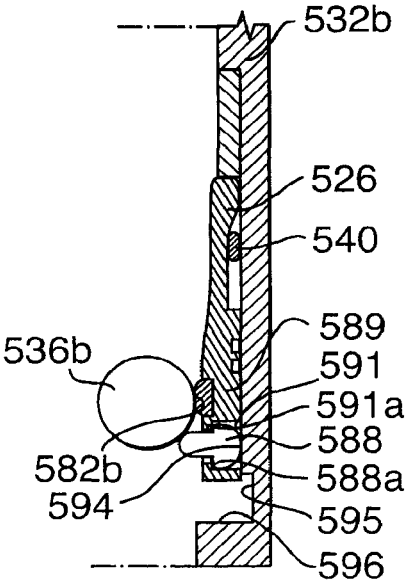
FIG. 6E is a sectional view through another sleeve according to an aspect of the invention.

FIG. 6E shows a ball stop formed of split ring segments 588 positioned adjacent a sealing area 582*b*. The split ring forms a yieldable seat in a driver sleeve 589. In this illustrated embodiment, the split ring is secured in a gland 591 of the driver sleeve with edges 588*a* retained behind returns 591*a* of gland. Gland 591 is open such that ring segments ride along a portion of a sliding sleeve valve 532*b* between a supporting area 594 and a recess 595. When positioned over the supporting area, the segments 588 protrude into the inner bore to hold a ball 536*b* against the sealing area. Segments 588 cannot retract, as they are held at their backside by supporting area 594. As such, a pressure differential can be built up across the ball and sealing area 582*b* to create a hydraulic force to move sleeve 589 down against a stop wall 596. Movement of sleeve 589 moves segments over recess where they are able to expand and release ball 536*b*. The backside of segments are rounded to permit ease of movement along supporting area 594. Movement of sleeve 589 also draws a collet 526 attached thereto over a constricting surface 540 to form a ball seat. Thereafter, a ball can be dropped to land and seal in collet 526 to shift sleeve 532*b*.

Knowing the diameter of the ball to be used in the ball stop, the ball stop can be sized to stop the ball from moving therepast and the sealing area can have an inner diameter selected to fit closely against the ball. As such, the ball stop holds the ball in the sealing section. Once the ball stop prevents the ball from moving through the tool, the ball will be positioned adjacent the sealing area and the resulting seal can allow pressure to be built up behind the ball and apply force, depending on the intended use of the ball stop, to move the driver on which it is installed or to cause the sliding sleeve valve to shift from the closed to the open position. As such, the ball stop itself needs only retain the ball, but not actually create a seal with the ball. This allows greater flexibility with the formation of the stop without also having to consider its sealing properties both initially and after use downhole.

Other mechanical devices can be used to move valves to an active position and then a ball can be pumped down the tubing or casing to shift the sleeve to the open position.

It will be appreciated that although components may be shown as single parts, they are typically formed of a plurality of connected parts to facilitate manufacture. Components described herein are intended for downhole use and may be formed of materials and by processes to withstand the rigors of such downhole use.

The sleeves may be installed in a tubular for connection into a tubular string, such as in the form of a sub. With reference to FIG. 4 for example, sleeve 332 may be installed in a sub. The sub includes a tubular body 360 including an inner bore defined by an inner wall 362 and sleeve 332 is installed in the tubular inner bore and is axially slidable therein at least from a first position to a second position. As will be appreciated, the second position is generally defined by a shoulder 364 on the tubular inner wall against which the sleeve may be stopped. Generally, the sliding sleeve is mounted in a recessed area 366 formed in the inner bore of the tubular body such that the sleeve can move in the recess until it stops against shoulder 364 formed by the lower stepped edge of that recess. The tubular upper and lower ends 368*a*, 368*b* may be formed, such as by forming as threaded boxes and/or pins, to accept connection into a wellbore tubular string.

In use, one or more of the reconfigurable sleeves may be positioned in a tubing string. Because of their usefulness to increase the possible numbers of sleeves in any tubing string, the reconfigurable sleeves may often be installed above one or more sleeves having a set valve seat. For example, with reference to FIG. 7, a wellbore tubing string apparatus may include a tubing string 614 having a long axis and an inner bore 618, a first sleeve 632 in the tubing string inner bore, the first sleeve being moveable along the inner bore from a first position to a second position; a second sleeve 622*a* in the tubing string inner bore, the second sleeve offset from the first sleeve along the long axis of the tubing string, the second sleeve being moveable along the inner bore from a third position to a fourth position; and a third sleeve 622*b* offset from the second sleeve and moveable along the tubular string from a fifth position to a sixth position. The first sleeve may be reconfigurable, such as by one of the embodiments noted in FIGS. 2 to 5 above or otherwise, having a driver 638 therein to form a valve seat (not yet formed) upon actuation thereof. The second and third sleeves may be reconfigurable or, as shown, standard sleeves, with set valve seats 626*a*, 626*b* therein. An actuator device, such as ball 636 may be provided for actuating the first sleeve, as it passes thereby, to form a valve seat on the first sleeve. The actuator device may be a device, as shown, for acting with driver 638 to actuate the formation of a valve seat on the first sleeve and also serves the purpose of landing in and creating a seal against the second sleeve seat 626*a* to permit the second sleeve to be driven by fluid pressure from the third position to the fourth position. Alternately, the actuator device may have the primary purpose of acting on driver 638 without also acting to seal a lower sleeve.

In the illustrated embodiment, for example, the sleeve furthest downhole, sleeve 622*b*, includes a valve seat with a diameter D1 and the sleeve thereabove has a valve seat with a diameter D2. Diameter D1 is smaller than D2 and so sleeve 622*b* requires the smaller ball 623 to seal thereagainst, which can easily pass through the seat of sleeve 622*a*. This provides that the lowest sleeve 622*b* can be actuated to open first by launching ball 623 which can pass without effect through all of the sleeves 622*a*, 632 thereabove but will land in and seal against seat 626*b*. Second sleeve 622*a* can likewise be actuated to move along tubing string 612 by ball 636 which is sized to pass through all of the sleeves thereabove to land and seal in seat 626*a*, so that pressure can be built up thereabove. However, in the illustrated embodiment, although ball 636 can pass through the sleeves thereabove, it may actuate those sleeves, for example sleeve 632, to generate valve seats thereon. For example, driver 638 on sleeve 632 includes a catcher portion 646 with a diameter D2 that is formed to catch and retain ball 636 such that pressure can be increased to move the driver along sleeve 632 to open the catcher but create a valve seat in another area, for example portion 642 of the driver. Catcher 646, being opened, releases ball 636 so it can continue to seat 626*a*.

Of course, where the first sleeve, with the configurable valve seat, is positioned above other sleeves with valve seats formable or fixed thereon, the formation of the valve seat on the first seat should be timed or selected to avoid interference with access to the valve seats therebelow. As such, for example, the inner diameter of any valve seat formed on the first sleeve should be sized to allow passage thereby of actuation devices or plugging balls for the valves therebelow. Alternately, and likely more practical, the timing of the actuation of the first sleeve to form a valve seat is delayed until access to all larger diameter valve seats therebelow is no longer necessary, for example all such larger diameter valve seats have been actuated or plugged.

In one embodiment as shown, the wellbore tubing string apparatus may be useful for wellbore fluid treatment and may include ports 617 over or past which sleeves 622*a*, 622*b*, 632 act.

In an embodiment where sleeves 622*a*, 622*b*, 632 are positioned to control the condition of ports 617, note that, as shown, in the closed port position, the sleeves can be positioned over their ports to close the ports against fluid flow therethrough. In another embodiment, the ports for one or both sleeves may have mounted thereon a cap extending into the tubing string inner bore and in the position permitting fluid flow, their sleeve has engaged against and opened the cap. The cap can be opened, for example, by action of the sleeve shearing the cap from its position over the port. Each sleeve may control the condition of one or more ports, grouped together or spaced axially apart along a path of travel for that sleeve along the tubing string. In yet another embodiment, the ports may have mounted thereover a sliding sleeve and in the position permitting fluid flow, the first sleeve has engaged and moved the sliding sleeve away from the first port. For example, secondary sliding sleeves can include, for example, a groove and the main sleeves (622*a*, 632) may include a locking dog biased outwardly therefrom and selected to lock into the groove on the sub sleeve. These and other options for fluid treatment tubulars are more fully described in applicants US Patents noted hereinbefore.

The tubing string apparatus may also include outer annular packers 620 to permit isolation of wellbore segments.

The packers can be of any desired type to seal between the wellbore and the tubing string. In one embodiment, at least one of the first, second and third packer is a solid body packer including multiple packing elements. In such a packer, it is desirable that the multiple packing elements are spaced apart. Again the details and operation of the packers are discussed in greater detail in applicants earlier US Patents.

Figure 7:
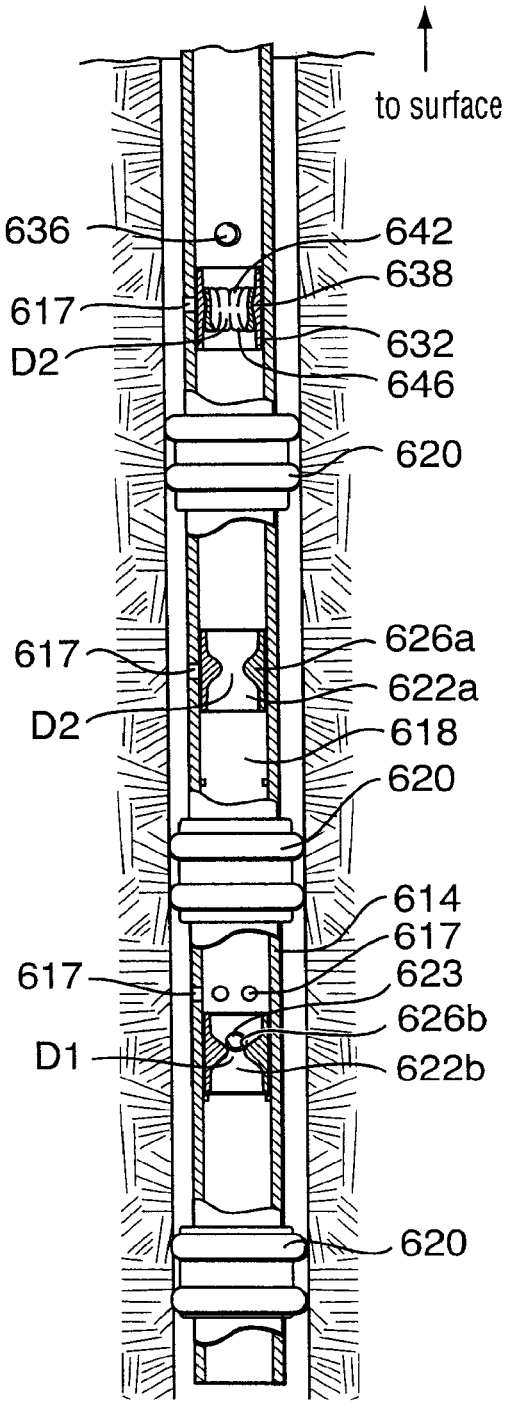
FIG. 7 is a sectional view through a wellbore having positioned therein a fluid treatment assembly and showing a method according to the present invention.

In use, a wellbore tubing string apparatus, such as that shown in FIG. 7 including reconfigurable sleeves, for example according to one of the various embodiments described herein or otherwise may be run into a wellbore and installed as desired. Thereafter the sleeves may be shifted to allow fluid treatment or production through the string. Generally, the lower most sleeves are shifted first since access to them may be complicated by the process of shifting the sleeves thereabove. In one embodiment, for example, the sleeve shifting device, such as a plugging ball may be conveyed to seal against the seat of a sleeve and fluid pressure may be increased to act against the plugging ball and its seat to move the sleeve. At some point, any configurable sleeves are actuated to form their valve seats. As will be appreciated from the foregoing description, an actuating device for such purpose may take various forms. In one embodiment, as shown in FIG. 7, the actuating device is a device launched to also plug a lower sleeve or the actuating device may act apart from the plugging ball for lower sleeves. For example, the actuating device may include a magnetic rod, etc. that actuates a valve seat to be formed on a reconfigurable sleeve as it passes thereby. In another embodiment, a plugging ball for a lower sleeve may actuate the formation of a valve seat on the first sleeve as it passes thereby and after which may land and seal against the valve seat of sleeve with a set valve seat. As another alternate method, a device from below a configurable sleeve can actuate the sleeve as it passes upwardly through the well. For example, in one embodiment, a plugging ball, when it is reversed by reverse flow of fluids, can move past the first sleeve and actuate the first sleeve to form a valve seat thereon.

The method can be useful for fluid treatment in a well, wherein the sleeves operate to open or close fluid ports through the tubular. The fluid treatment may be a process for borehole stimulation using stimulation fluids such as one or more of acid, gelled acid, gelled water, gelled oil, $CO_2$, nitrogen and any of these fluids containing proppants, such as for example, sand or bauxite. The method can be conducted in an open hole or in a cased hole. In a cased hole, the casing may have to be perforated prior to running the tubing string into the wellbore, in order to provide access to the formation. In an open hole, the packers may be of the type known as solid body packers including a solid, extrudable packing element and, in some embodiments, solid body packers include a plurality of extrudable packing elements. The methods may therefore, include setting packers about the tubular string and introducing fluids through the tubular string.

FIGS. 8A to 8F show a method and system to allow several sliding sleeve valves to be run in a well, and to be selectively activated. The system and method employs a tool such as, for example, that shown in FIG. 3 that will shift through several "passive" shifting cycles (positions 2-3). Once the valves pass through all the passive cycles, they can each move to an "active" state (position 4, FIG. 3D). Once it shifts to the active state, the valve can be shifted from closed to open position, and thereby allow fluid placement through the open parts from the tubing to the annulus.

Figure 8A:
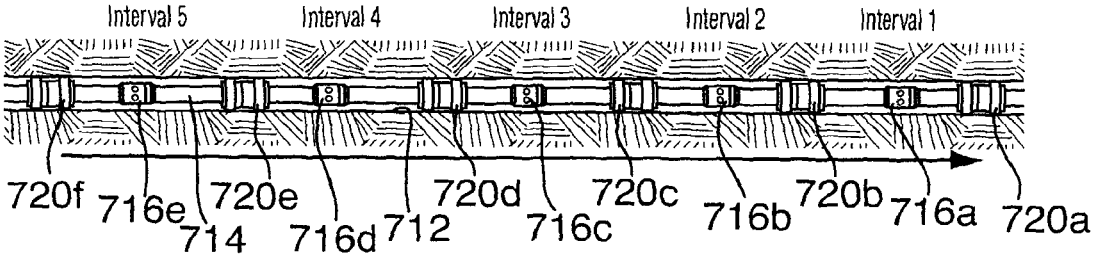
FIGS. 8A to 8F are a series of schematic sectional views through a wellbore having positioned therein a fluid treatment assembly showing a method according to the present invention.

FIG. 8A shows a tubing string 714 in a wellbore 712. A plurality of packers 720*a-f* can be expanded about the tubing string to segment the wellbore into a plurality of zones where the wellbore wall is the exposed formation along the length between packers. The string may be considered to have a plurality of intervals 1-5 between each adjacent pair of packers. Each interval includes at least one port and a sliding sleeve valve thereover (within the string), which together are designated 716*a-e*. Sliding sleeve valve 716*a* includes a ball stop, called a seat that permits a ball-driver movement of the sleeve. Sliding sleeve valves 716*b* to 716*e* includes seats formable therein when actuated to do so, such as for example a seat 226 that is compressible to a ball retaining diameter, as shown in FIGS. 3A-D.

Initially, as shown in FIG. 8A, all ports are in the closed position, wherein they are closed by their respective sliding sleeve valves.

Figure 8B:
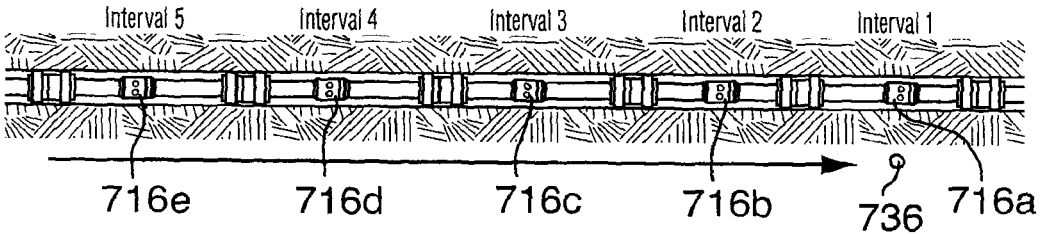

As shown in FIG. 8B a ball 736 may be pumped onto a seat in the sleeve 716*a* to open its port in Interval 1. When the ball passes through the sleeves 716*c-e* in Intervals 5, 4, and 3, they make a passive shift. When the ball passes through Interval 2, it generates a ball stop on that sleeve 716*b* such that it can be shifted to the open position when desired.

Figure 8C:
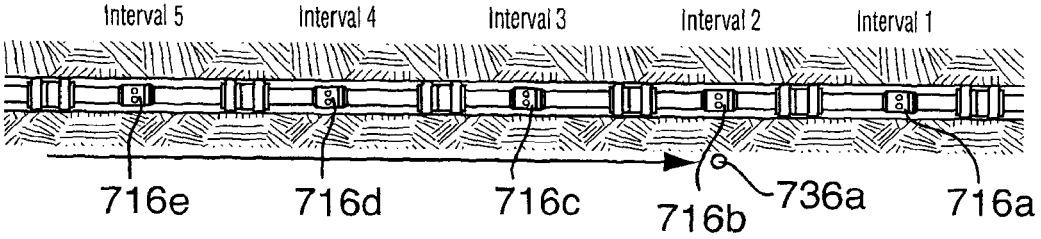

Next, as shown in FIG. 8C, a ball 736*a* is pumped onto the activated seat in sleeve 716*b* to open the port in Interval 2. When it passes through the sleeves in Intervals 5, and 4, they make a passive shift. When the ball passes through Interval 3, it moves sleeve 716*c* from passive to active so that it can be shifted to the open position when desired.

Figure 8D:
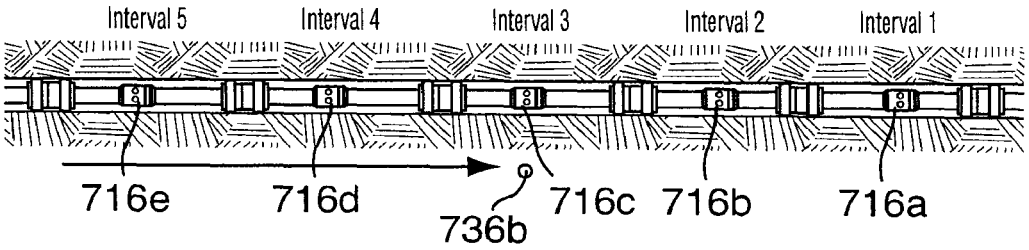

Thereafter, as shown in FIG. 8D, a ball 736*b* is pumped onto the activated seat in sleeve 716*e* to open the port in Interval 3. When it passes through the sleeve 716*e* in Interval 5, that sleeve makes a passive shift. When the ball passes through Interval 4, it moves sleeve 716*d* from passive to active so that it can be shifted to the open position when desired.

Figure 8E:
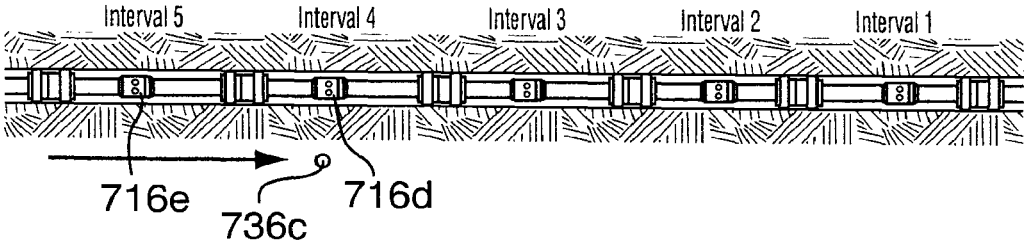

Thereafter, as shown in FIG. 8E, a ball 736*c* is pumped onto the activated seat of sleeve 716*d* to open the port in Interval 4. When ball 736*c* passes through Interval 5, it moves sleeve 716*e* from passive to active so that it can be shifted to the open position when desired.

Figure 8F:
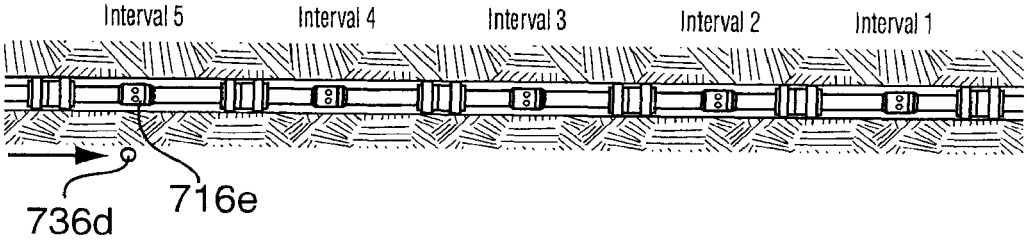

Thereafter, as shown in FIG. 8F, a ball 736*d* is pumped onto the activated seat of sleeve 716*e* to open the port in Interval 5 completing opening of all ports. Note that more than five ports can be run in a string.

When the ports are each opened, the formation accessed therethrough can be stimulated as by fracturing. It is noted, therefore, that the formation can be treated in a focused, staged manner. It is also noted that balls 736-736*d* may all be the same size. The intervals need not be directly adjacent as shown but can be spaced.

This system and tool of FIG. 8 provides a substantially unrestricted internal diameter along the string and allows a single sized ball or plug to function numerous valves. By eliminating reduction in internal diameter to seat balls, the system may improve the ability to pump at high rates without causing abrasion to port tools. The system may be activated using an indexing j-slot system as noted. The system may be activated using a series of collet, c-rings or deformable seats. The system can be used in combination with solid ball seats. The system allows for installations of fluid placement liners of very long length forming large numbers of separately accessible wellbore zones.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A wellbore tubular string comprising:

an upper end and a distal end; and a first sliding sleeve sub and a second sliding sleeve sub, the first sliding sleeve sub being positioned between the upper end and the second sliding sleeve sub, and each of the first sliding sleeve sub and the second sliding sleeve sub including:

a tubular body including an upper end and an inner bore defined by an inner wall;

a sleeve installed in the inner bore and axially slideable therein at least from a first position to a second position, the sleeve having an inner diameter and an outer diameter facing the inner wall;

a ball stop carried by the sleeve, the ball stop having a protruding position when the sleeve is in the first position wherein the ball stop extends at least partially into the inner bore, and the ball stop having a retracted position when the sleeve is in the second position wherein the ball stop is retracted from the protruding position; and a sealing area on the sleeve between the ball stop and the upper end, the ball stop configured when in the protruding position to stop a plug passing through the inner bore to hold the plug in a scaling position with the sealing area, to thereby move the sleeve from the first position to the second position, and the ball stop configured to retract to the retracted position when the sleeve is in the second position to release the plug, wherein the first sliding sleeve sub further includes an indexing mechanism for returning the sleeve to the first position and the ball stop to the protruding position after arriving at the second position.

2. The wellbore tubular string of claim 1 wherein the indexing mechanism is configurable to allow shifting of the sleeve of the first sliding sleeve sub from the second position to the first position more than one time.

3. The wellbore tubular string of claim 1 wherein the sealing area is a portion of the ball stop.

4. The wellbore tubular string of claim 1 wherein the sealing area is an annular area on the inner diameter of the sleeve adjacent to the ball stop.

5. The wellbore tubular string of claim 1 wherein the sealing area is deformable.

6. The wellbore tubular string of claim 1 wherein the sealing area is non-deformable.

7. The wellbore tubular string of claim 1 wherein the ball stop includes a ball stop member installed in the sleeve with an end exposed in the inner diameter and a back side exposed at the outer diameter.

8. The wellbore tubular string of claim 7 wherein the backside is supported against the inner wall.

9. The wellbore tubular string of claim 1 wherein the ball stop is an expandable split ring.

10. The wellbore tubular string of claim 1 wherein the ball stop is a plurality of detent pins.

11. The wellbore tubular string of claim 1 further comprising a sub with a set seat, the sub being positioned between the second sliding sleeve sub and the distal end, the set seat configured to permanently stop downward movement of the plug released from the second sliding sleeve sub.

12. The wellbore tubular string of claim 1 wherein in the second position the sleeve of the second sliding sleeve sub opens a port in the tubular body.

13. The wellbore tubular string of claim 1 wherein in the second position the sleeve of the second sliding sleeve sub forms a seat on the sleeve configured to stop a second plug.

* * * * *